US011390072B2

(12) United States Patent
Linn et al.

(10) Patent No.: US 11,390,072 B2
(45) Date of Patent: Jul. 19, 2022

(54) FLUIDIC DIE

(71) Applicant: HEWLETT-PACKARD DEVELOPMENT COMPANY, L.P., Spring, TX (US)

(72) Inventors: Scott A Linn, Corvallis, OR (US); Eric Martin, Corvallis, OR (US); Vincent C Korthuis, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 172 days.

(21) Appl. No.: 16/619,029

(22) PCT Filed: Jul. 12, 2017

(86) PCT No.: PCT/US2017/041641

§ 371 (c)(1),
(2) Date: Dec. 3, 2019

(87) PCT Pub. No.: WO2019/013772

PCT Pub. Date: Jan. 17, 2019

(65) Prior Publication Data

US 2021/0331465 A1 Oct. 28, 2021

(51) Int. Cl.
*B41J 2/045* (2006.01)

(52) U.S. Cl.
CPC ..... *B41J 2/04573* (2013.01); *B41J 2/0452* (2013.01); *B41J 2/0458* (2013.01); *B41J 2/04543* (2013.01); *B41J 2/04581* (2013.01)

(58) Field of Classification Search
CPC .. B41J 2/04573; B41J 2/0452; B41J 2/04543; B41J 2/0458; B41J 2/04581
See application file for complete search history.

(56) References Cited

U.S. PATENT DOCUMENTS 5,587,730 A 12/1996 Karz
6,280,012 B1 8/2001 Schloeman
6,318,828 B1 * 11/2001 Barbour ..... B41J 2/0451 347/11

(Continued)

FOREIGN PATENT DOCUMENTS

CN 1872550 12/2006
CN 103619605 3/2014

(Continued)

OTHER PUBLICATIONS

Biver, E et al., High-speed Multi-jets Printing Using Laser Forward Transfer: Time-resolved Study of the Ejection Dynamics, Jul. 7, 2014, <https://www.osapublishing.org/oe/abstract.cfm?uri=oe-22-14-17122>.

*Primary Examiner* — Jason S Uhlenhake
(74) *Attorney, Agent, or Firm* — Fabian VanCott

(57) ABSTRACT

A fluidic die includes a number of actuators to eject fluid from the fluidic die. The number of actuators form a number of primitives. The fluidic die includes a plurality of delays within a column of the primitives, and a processing device to control the delays through which a number of activation pulses pass. The activation pulses activate each of the actuators associated with the primitives. The activation pulses are delayed between the primitives via at least one of the delays to reduce peak power demands of the fluidic die.

19 Claims, 7 Drawing Sheets

(56) References Cited

U.S. PATENT DOCUMENTS

| | | | | |
|---|---|---|---|---|
| 6,575,548 | B1 | 6/2003 | Corrigan, III | |
| 7,083,246 | B2 | 8/2006 | Yeh et al. | |
| 7,780,256 | B2 | 8/2010 | Sheahan et al. | |
| 8,403,447 | B1 | 3/2013 | Gardner et al. | |
| 9,475,286 | B2 | 10/2016 | Tuttnauer et al. | |
| 9,776,395 | B2 | 10/2017 | Anderson et al. | |
| 10,434,768 | B2 | 10/2019 | Fricke et al. | |
| 2002/0070992 | A1 | 6/2002 | Fukano | |
| 2005/0030344 | A1 | 2/2005 | Edelen | |
| 2006/0074103 | A1 | 12/2006 | Corte et al. | |
| 2006/0274093 | A1 | 12/2006 | Kobayashi | |
| 2006/0274103 | A1 | 12/2006 | Kim | |
| 2011/0169885 | A1* | 7/2011 | Linn | B41J 2/0458 347/10 |
| 2014/0204148 | A1 | 7/2014 | Ge et al. | |
| 2017/0313059 | A1* | 11/2017 | Fricke | B41J 2/04543 |
| 2018/0001628 | A1 | 1/2018 | Maxfield | |

FOREIGN PATENT DOCUMENTS

| | | | |
|---|---|---|---|
| CN | 105764695 | | 7/2016 |
| JP | 02078558 | | 3/1990 |
| JP | H07125195 | | 5/1995 |
| JP | 2002254707 | | 9/2002 |
| JP | 2004042305 | | 2/2004 |
| JP | 2017530890 | | 10/2017 |
| TW | 200518939 | A | 6/2005 |
| TW | 201545903 | A | 12/2015 |
| WO | WO-2011112200 | | 9/2011 |
| WO | 2015/080709 | A1 | 6/2015 |
| WO | 2016/068884 | A1 | 5/2016 |
| WO | WO-2016068888 | A1 | 5/2016 |

* cited by examiner

500

600

FLUIDIC DIE

BACKGROUND

A fluid ejection printing system includes a printhead, a fluid supply which supplies fluid such as ink to the printhead, and a controller to control the printhead. The printhead may eject fluid through a plurality of orifices or nozzles toward a print medium, such as a sheet of paper, in order to print the fluid onto the print medium. The orifices may be arranged in a number of arrays such that properly sequenced ejection of ink from the orifices causes characters or other images to be printed upon the print medium as the printhead and the print medium are moved relative to each other.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
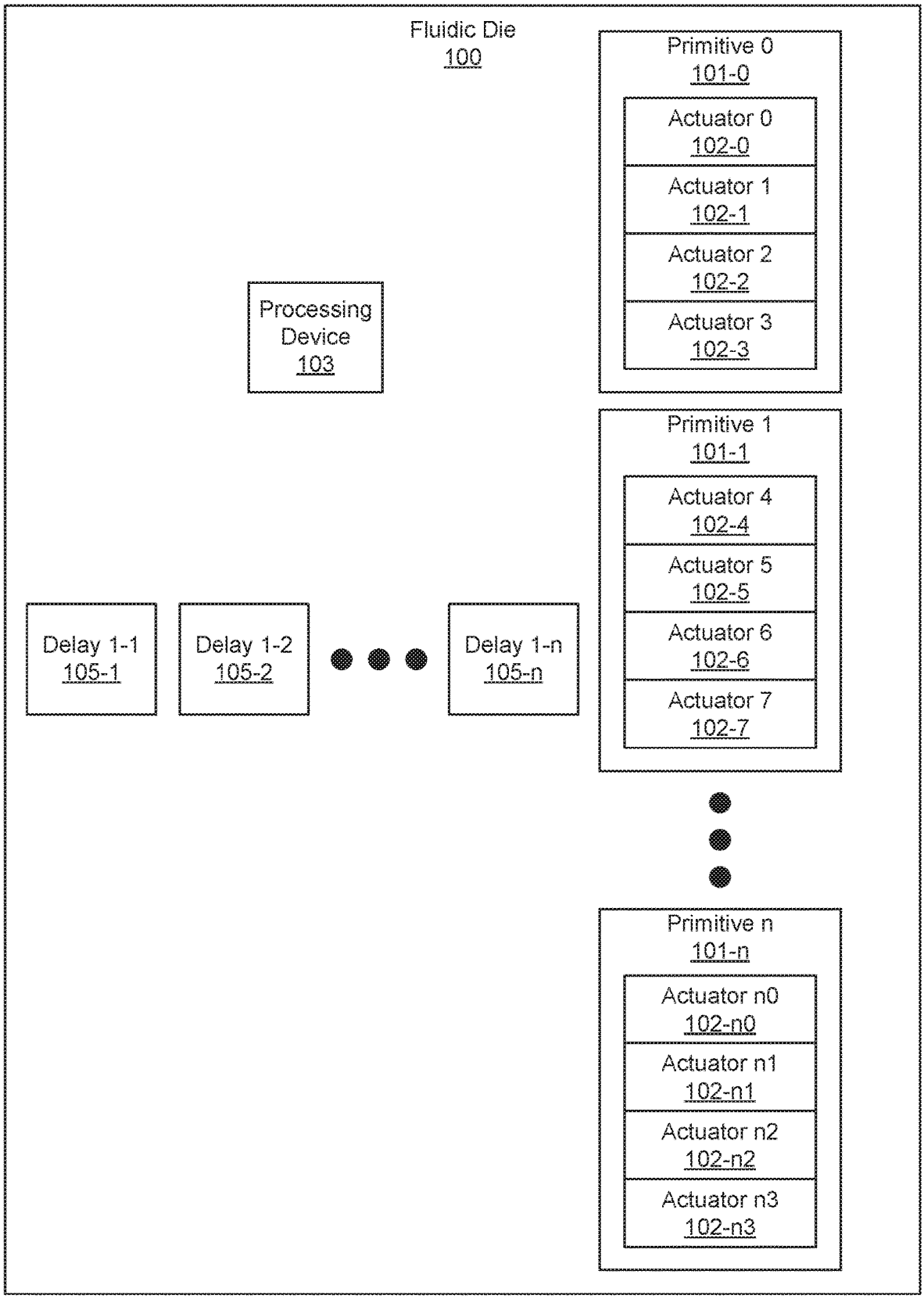
FIG. 1 is a block diagram of a fluidic die, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In one example, a printhead may eject the fluid through the nozzles by activating a number of fluid actuators. In one example, the fluid actuators may include thermal resistive devices that rapidly heat a small volume of the fluid located in vaporization chambers to cause the fluid to vaporize and be ejected from the nozzles. In another example, the fluid actuators may include piezoelectric materials located in a number of fluid chambers that change their shape when an electric field is applied to them to increase pressure within the fluid chambers forcing the fluid from the fluid chambers. To activate the fluid actuators, power is supplied to the fluid actuators. Power consumed by the fluid actuators may be equal to Vi, where V is the voltage across the fluid actuators and i is the current through the fluid actuators. The electronic controller, which may be located as part of the processing electronics of a printing device, controls the power supplied to the fluid actuators from a power supply which is external to the printhead.

In one type of fluid ejection printing system, printheads receive activation signals including a number of activation pulses from the controller. The controller controls the drop generator energy of the printhead by controlling the activation signal timing. The timing related to the activation signal includes the width of the activation pulses and the point in time at which the activation pulse occurs. The controller may also control a drop generator energy by controlling the electrical current passed through the fluid actuators by controlling the voltage level of the power supply.

Printheads may include a plurality of fluid actuators used to eject the fluid from the printhead, and these fluid actuators may be grouped together into a plurality of primitives. In one example, the number of fluid actuators in each primitive may vary from primitive to primitive. In another example, the number of fluid actuators may be the same for each primitive.

Each fluid actuator includes an associated switching device such as, for example, a field effect transistor (FET). In one example, a single power lead provides power to each FET and fluid actuators in each primitive. In one example, each FET in a primitive may be controlled with a separately energizable address lead coupled to the gate of the FET. In another example, each address lead may be shared by multiple primitives. The address leads are controlled so that only one FET is switched on at a given time so that at most a single fluid actuator in a primitive has electrical current passed through it to cause the fluid in the corresponding chamber to eject fluid at the given time. In one example, the primitives may be arranged in the printhead in rows and columns. There may exist any number of columns of primitives and any number of rows of primitives within the printhead.

Each fluid actuator in a primitive may be assigned an address. In most circumstances, only one fluid actuator per primitive is actuated at a time, based on the address provided to the primitive. When an activation pulse is conveyed to a column of primitives, that activation pulse is delayed between primitives or primitive groups. This delay reduces peak currents and maximum time rate of change of the current (di/dt) in order to avoid over-burdening the power supply to the printhead and in order to provide enough power to each actuator within the printhead. The primitive delays also act as a type of virtual primitive where it acts as an unactuated or "off" primitive, resulting in the maximum number of primitives that are active or "on" is less. This causes the power consumption to be limited and reduces peak current within the printhead or fluidic die. One cost to causing the printhead to utilize the primitive delays is that the activation pulse takes longer to get to the bottom of the column of primitives and complete the activation pulse for all the primitives in the column. This equates to being unable to complete a print job as fast as may otherwise be possible since a subsequent or next activation pulse cannot initiate at the first or top primitive until activation has initiated in the bottom primitive for the previous activation event. Consequently, in some systems, the maximum activation frequency may be limited by the time it takes for the activation pulse to propagate down the column of primitives. For reasons stated herein, a fluidic die that provides greater control of current within the printhead may prove effective in ensuring a decrease in the maximum time rate of change of the current (di/dt) within the fluidic die.

Examples described herein provide a fluidic die. The fluidic die may include a number of actuators to eject fluid from the fluidic die. The number of actuators form a number of primitives. A plurality of delays may be included within a column of the primitives. The fluidic die may also include a processing device to control the delays through which a number of activation pulses pass. The activation pulses activate each of the actuators associated with the primitives. The activation pulses are delayed between the primitives via at least one of the delays to reduce peak power demands of the fluidic die.

The fluidic die may further include an activation pulse generator on the fluidic die. The actuators, in one example, may be driven based on a pre-cursor pulse time (PCP), a dead time (DT), and a fire pulse time (FPT) generated by the fire pulse generator. Further, a time for each edge of the activation pulses is stored in a die memory. The activation pulse generator sends the PCP, DT, and FPT down the column of primitives. In another example, a single fire pulse (FP) may be sent down the column. In both of these examples, however, the delay elements described herein serve the same function for both types of pulses.

The plurality of delays through which the activation pulses pass may be based on a number of nozzles within each primitive, the number of primitives, a print function, a print demand, or combinations thereof. The activation pulses include a pulse train comprising a number of the activation pulses, wherein the sum of the activation pulses form a total activation energy. The activation pulses are delayed between the primitives via a plurality of the delays. The fluidic die may further include a multiplexer coupled to each primitive to select a number of the signals from the delays.

Examples described herein also provide a printing device. The printing device may include a number of fluidic die. The fluidic die may include a number of actuators to eject fluid from the fluidic die where the number of actuators forming a plurality of primitives. The fluidic die may also include a plurality of delays within a column of the primitives, the delays being interposed between each primitive, and a processing device to control a number of delays through which a number of activation pulses pass, the activation pulses activating the actuators associated with the primitives.

The printing device may also include a multiplexer coupled to each primitive to select a number of the signals from the delays based on instructions received from the processing device. The instructions received from the processing device define a temporal delay between each of the primitives to reduce peak power demands of the fluidic die. The multiplexer selects a plurality of the signals from the delays. The printing device may include a programmable clock divider where the programmable clock divider divides a signal from a shift clock to slow down the propagation of the activation pulses down the column of primitives. A temporal delay between the primitives may be based on a number of actuators within each primitive, the number of primitives, a print function, a print demand, or combinations thereof. The activation pulses comprise a pulse train comprising a number of the activation pulses, wherein the sum of the activation pulses form a total activation energy.

Examples described herein further provide a method of reducing peak power demands of at least one fluidic die. The method may include; with a processing device, determining a primitive delay of the fluidic die based on instructions received from the processing device. The processing device may instruct the fluidic die to delay a number of activation pulses for a number of actuators within a column of nozzle primitives using a plurality of delays between each of the primitives. The method may also include generating an activation pulse for each of the nozzle primitives of the fluidic die, and activating, via the activation pulse; a number of the actuators coupled to each of a number of nozzles associated with the nozzle primitives based on the primitive delay. The method may also include delaying the activation pulses between each of the nozzle primitives via a plurality of the delays. The method may further include selecting, with a multiplexer coupled to the plurality of the delays, a number of signals from the plurality of the delays.

As used in the present specification and in the appended claims, the term "a number of" or similar language is meant to be understood broadly as any positive number comprising 1 to infinity; zero not being a number; but the absence of a number.

In the following description, for purposes of explanation; numerous specific details are set forth in order to provide a thorough understanding of the present systems and methods. It will be apparent, however; to one skilled in the art that the present apparatus, systems, and methods may be practiced without these specific details. Reference in the specification to "an example" or similar language means that a particular feature, structure, or characteristic described in connection with that example is included as described; but may or may not be included in other examples.

Turning now to the figures, FIG. 1 is a block diagram of a fluidic die (100), according to an example of the principles described herein. The fluidic die (100) may be any device capable of ejecting fluids such as inks from an orifice such as, for example, a nozzle. Although the description herein relates to thermal inkjet or piezoelectric printheads, the descriptions regarding delay of primitives for decreasing current draws on a power source.

The fluidic die (100) may include a number of fluid actuators (102-0, 102-1, 102-2, 102-3, 102-4, 102-5, 102-6, 102-7, **102-*n*0, 102-*n*1, 102-*n*2, 102-*n*3, collectively referred to herein as 102) to eject fluid from the fluidic die (100). The actuators (102) may be any device used to move fluid in a direction or force the fluid through an orifice such as a nozzle. For example, the actuators (102) may be thermal resistive devices, piezoelectric devices, pumps, micro-pumps, micro-recirculation pumps, other ejection devices, or combinations thereof. In one example, each actuator (102) may include a switching device such as a field effect transistor (FET). The FETs may be controlled with a separately energizable address lead coupled to the gates of the FETs. In one example, each address lead may be shared by multiple primitives (101). The address leads are controlled so that only one FET is switched on at a given time so that at most a single actuator (102) in a primitive (101) has electrical current passed through it to activate the actuator (102**) at the given time.

The actuators (102) may be grouped into a number of primitives (101-0, 101-1, **101-*n*, collectively referred to herein as 101). A primitive (101) is any grouping of a number of actuators (102) within an array of actuators (102). In one example, the number of actuators (102) in each primitive (101) may vary from primitive to primitive. In another example, the number of actuators (102) may be the same for each primitive (101) within the fluid die (100). In the examples described herein, each primitive (101) may include four actuators (102) each. Further, various numbers of primitives (101) are depicted throughout the figures, and ellipses are included in the figures indicate the potential for any number of primitives (101) to be included within the fluidic die (100). Ellipses are used throughout the figures to denote that any number of that element may be included within the fluidic die (100**).

The fluidic die (100) may include a plurality of delays (105) within a column of the primitives (101). In one example, a set of a plurality of delays (105) may be included between each primitive (101) to provide instructions to each primitive (101) as the activation pulse used to actuate the actuators (102) is transmitted to each of the primitives (101) as to what degree the activation pulse is to be delayed. The delays (105) may be any device or circuit that delays the primitives' (101) use of the activation pulse or otherwise alters the timing at which a subsequent primitive (101) and its actuators (102) begin to activate. In one example, the delays (105) may cause a delay between activation of the primitives (101) of approximately 22 nanoseconds (ns) per delay (105) with a cumulative delay within a column of primitives (101) being approximately between 1.5 and 3 microseconds (μs).

The activation pulse activates each of the actuators (102) associated with the primitives (101) as instructed by a processing device (103). In one example, the plurality of delays (105) may be programmable. Further, each set of delays (105) between the primitives (101) may be programmed. In this example, the delays (105) may each be programmed differently to delay the activation pulse to a different temporal amount. In this manner, a processing device (103) may be used to program the delays (105). Each delay (105) may be used to delay the activation pulse and the activation of the actuators (102) within the primitives (101) at a different temporal amount based on which of the delays (105) are selected by the processing device (103). The activation pulses are delayed between the primitives via at least one of the delays to reduce peak power demands of the fluidic die. More regarding the fluidic die (100) is provided in more detail herein.

In one example, a number of primitives (101) may be grouped together such that the delay (105) applied to a first one of the primitives (101) may be divided by the number of primitives in that group. For example, if two primitives (101) were grouped together, and a delay (105) was selected for that group of two primitives (101), then the delay for these two primitives (101) is half the delay per primitive (100). In this manner, the delays (105) may programmed to delay a primitive (101) to a programmed temporal delay, and the grouping of the primitives (101) in this manner may be used to divide the delay (105) as to those groups of delays equivalent to the number of primitives (101) in the group.

Figure 2:
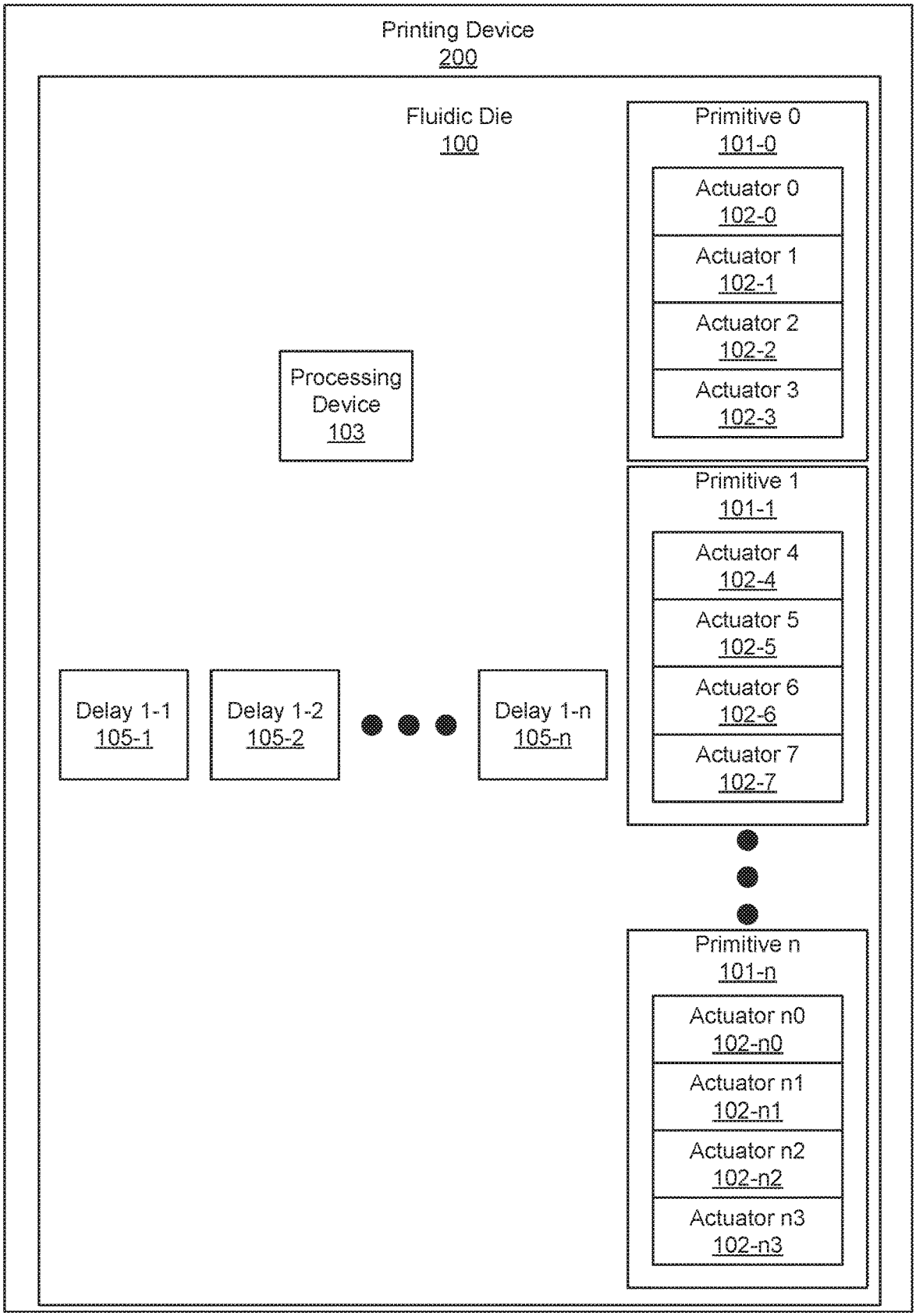
FIG. 2 is a block diagram of a printing device including a number of fluidic die of FIG. 1, according to an example of the principles described herein.

FIG. 2 is a block diagram of a printing device (200) including a number of fluidic die (100) of FIG. 1, according to an example of the principles described herein. Similarly-numbered elements included in FIG. 1 and described in connection with FIG. 1 designate similar elements within FIG. 2, The printing device (200) may be any device into which the fluidic die (100) may be incorporated. The printing device (200) may include any hardware to interface with the fluidic die (100), and provide instructions to the fluidic die (100) to print fluid. The instructions may be provided to the fluidic die (100) in the form of a page description language (PDL) used to control the printing device (200) functions and print a human-readable representation of graphics or text.

Any number of fluidic die (100) may be included within the printing device (100). Thus, although one fluidic die (100) is depicted within the printing device (200) of FIG. 2, a plurality of fluidic die (100) may be included. In this example of multiple fluid die (100) within the printing device (200), the procession device (103) may control all fluidic die (100) within the printing device (200). The printing device (200) may include a number of fluidic die (100) with each of the fluidic die (100) including a number of actuators (102) to eject fluid from the fluidic die (100). The number of actuators (102) form or may be grouped into a plurality of primitives (101). The printing device (200) may also include a plurality of delays (105) within a column of the primitives (101) where the delays (105) are interposed between each primitive (101). Further, the printing device (200) may also include a processing device (103) to control a number of the delays (105) through which a number of activation pulses (302) pass. The activation pulses (302) activate the fluid actuators (102) associated with the primitives (101).

Figure 3:
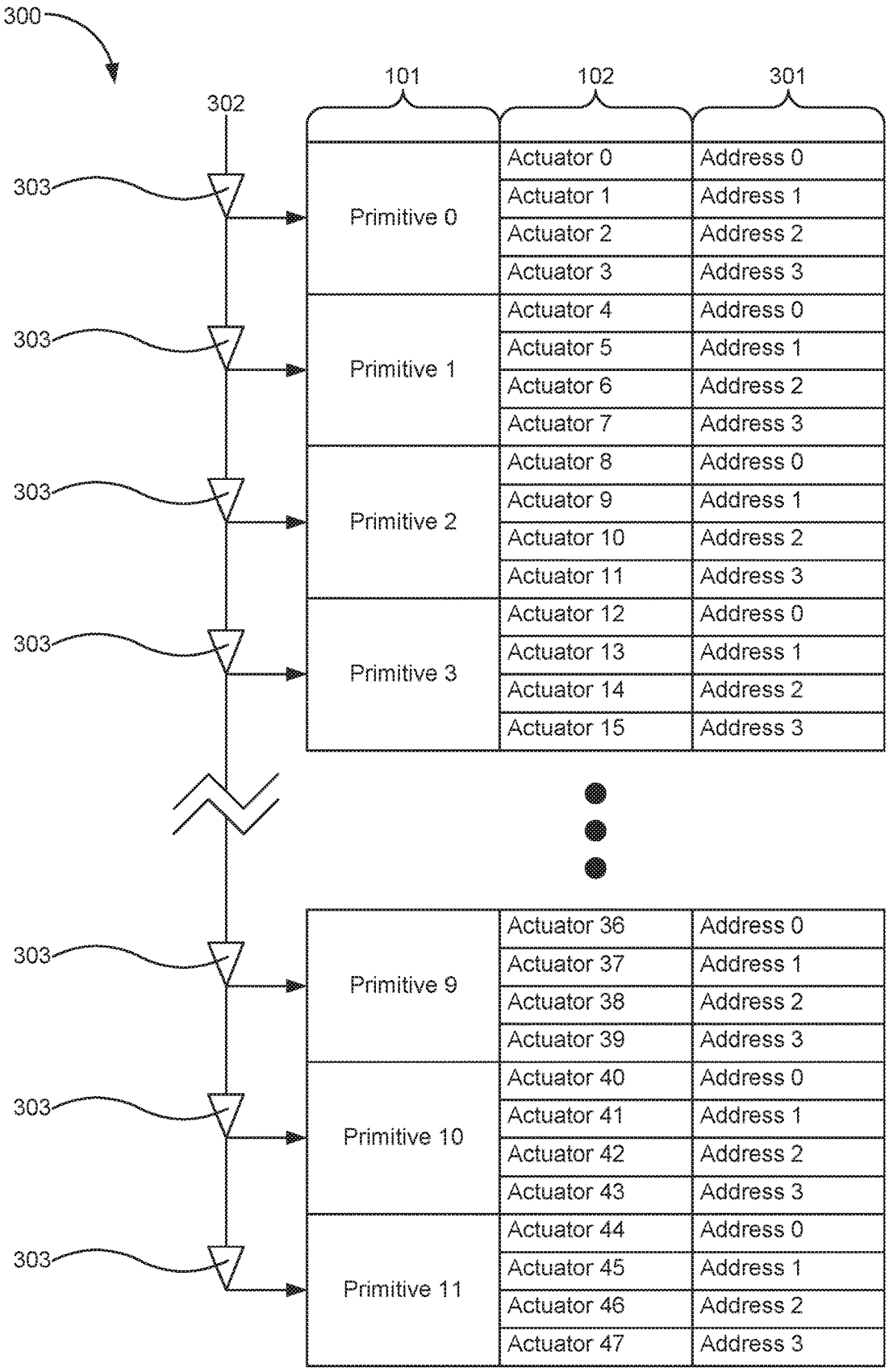
FIG. 3 is a block diagram of a primitive delay design, according to an example of the principles described herein.

FIG. 3 is a block diagram of a primitive delay design (300), according to an example of the principles described herein. Similarly-numbered elements included in FIGS. 1 and 2 and described in connection with FIGS. 1 and 2 designate similar elements within FIG. 3. The primitive delay design (300) may include a number of primitives (101), with each primitive (101) including a number of actuators (102). In order to digitally actuate the actuators (102), each actuator (102) may be assigned an address (301) that is unique to other actuators (102) within its respective primitive (101), is unique to all actuators (102) within the fluidic die (100), or combinations thereof. In one example, one actuator (102) is activated at and given time within a primitive (101). In this example, the address (301) provided to a primitive (101) identifies which of the actuators (102) is activated.

The activation pulse (302) is input at the top of the column of primitives (101). Each activation pulse (302) includes a pulse train that includes a number of the activation pulses where the sum of the activation pulses form a total activation energy. In one example, each pulse train may include a pre-cursor pulse (PCP), a dead time pulse (DTP), and a fire pulse (FP). The sum of the PCP, DTP, and FP form the total activation energy of the activation pulse (302).

The primitive delay design (300) may also include a number of delay blocks (303), represented by triangles, to selectively send the activation pulse (302) to a given primitive (101) and delay the firing of the actuators (102) within a primitive (101). The delay blocks (303) include the delays (105) as described herein. When the activation pulse (302) is conveyed to the column of primitives (101), that activation pulse (302) may be delayed between primitives (101) or primitive groups in order to reduce peak currents and maximum di/dt. In the example of FIG. 3, the activation pulse (302) propagates from top to bottom, and each locally delayed activation pulse (302) is conveyed to the associated primitive (101).

In one example, a memory device may be included in each of the primitives (101) in order to allow for a previous activation pulse (302) to propagate to at least the last primitive (101) in the column of primitives (101) while a next or subsequent activation pulse (302) initiates at the first primitive (101) at the top of the column of the primitives (101). However, activation of a top primitive (101) with the next or subsequent activation pulse (302) cannot initiate until activation has initiated in the bottom primitive (101) for the previous activation pulse (302). Consequently, in one example, the maximum activation frequency may be limited by the time it takes for the activation pulse (302) to propagate down the column of primitives (101).

Figure 4:
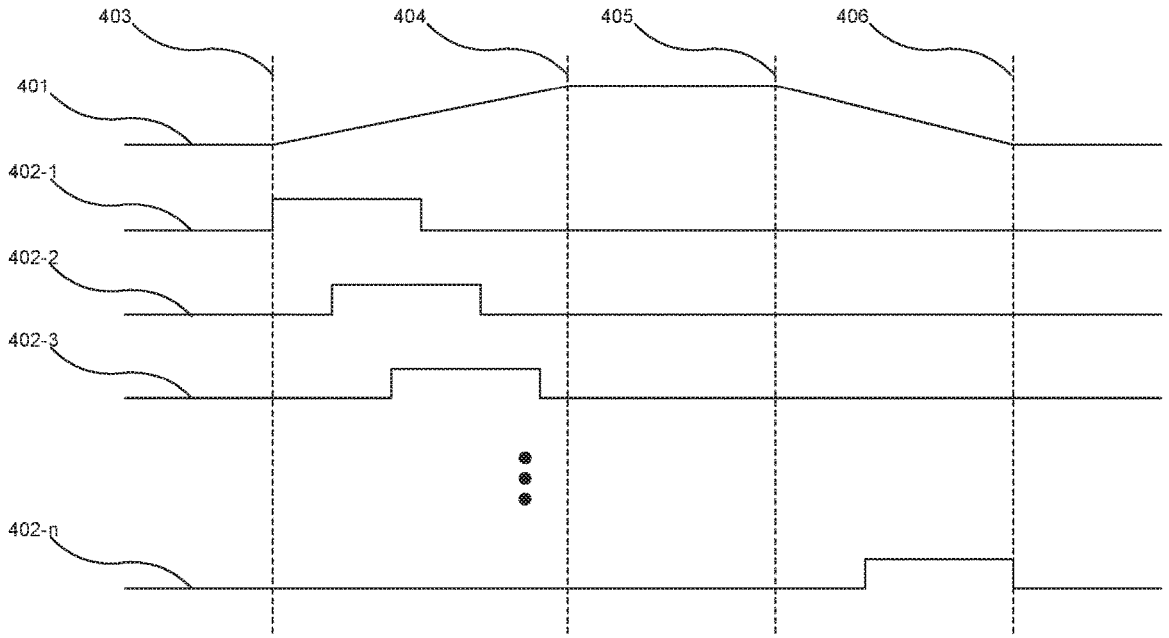
FIG. 4 is a line graph of a total current within a fluidic die during an activation of a number of primitives and in comparison to the activation of the primitives, according to an example of the principles described herein.

FIG. 4 is a line graph of a total current (401) within a fluidic die (100) during an activation of a number of primitives (101) and in comparison to the activation (402-1, 402-2, 402-3, **402-*n*, collectively referred to herein as 402) of the primitives (101), according to an example of the principles described herein. The activation (402) of a number of actuators (102) of the primitives (101) may be performed such that a leading edge of an activation (402-2, 402-3) of a subsequent primitive (101) occurs after and during a prior activation (402-1) of a previous primitive (101) and so on as all the primitives are activated (402-*n*). Thus, at time $t_1$ (403) the current begins to climb as the first (402-1) and subsequent (402-2, 402-3) primitives (101) actuate. Eventually, between $t_2$ (404) and $t_3$ (405), the current plateaus, and after the final few primitives (101) begin to deactivate, the current begins to decrease. The current decreases until the final primitive (101), at $t_4$ (406) completes its activation and deactivates. In this manner, delaying the activation of primitives (101) and their respective actuators (102) allows for the overall total current to be lower over time. The description of FIGS. 3 and 4 will now be utilized in describing FIGS. 5 and 6**.

Figure 5:
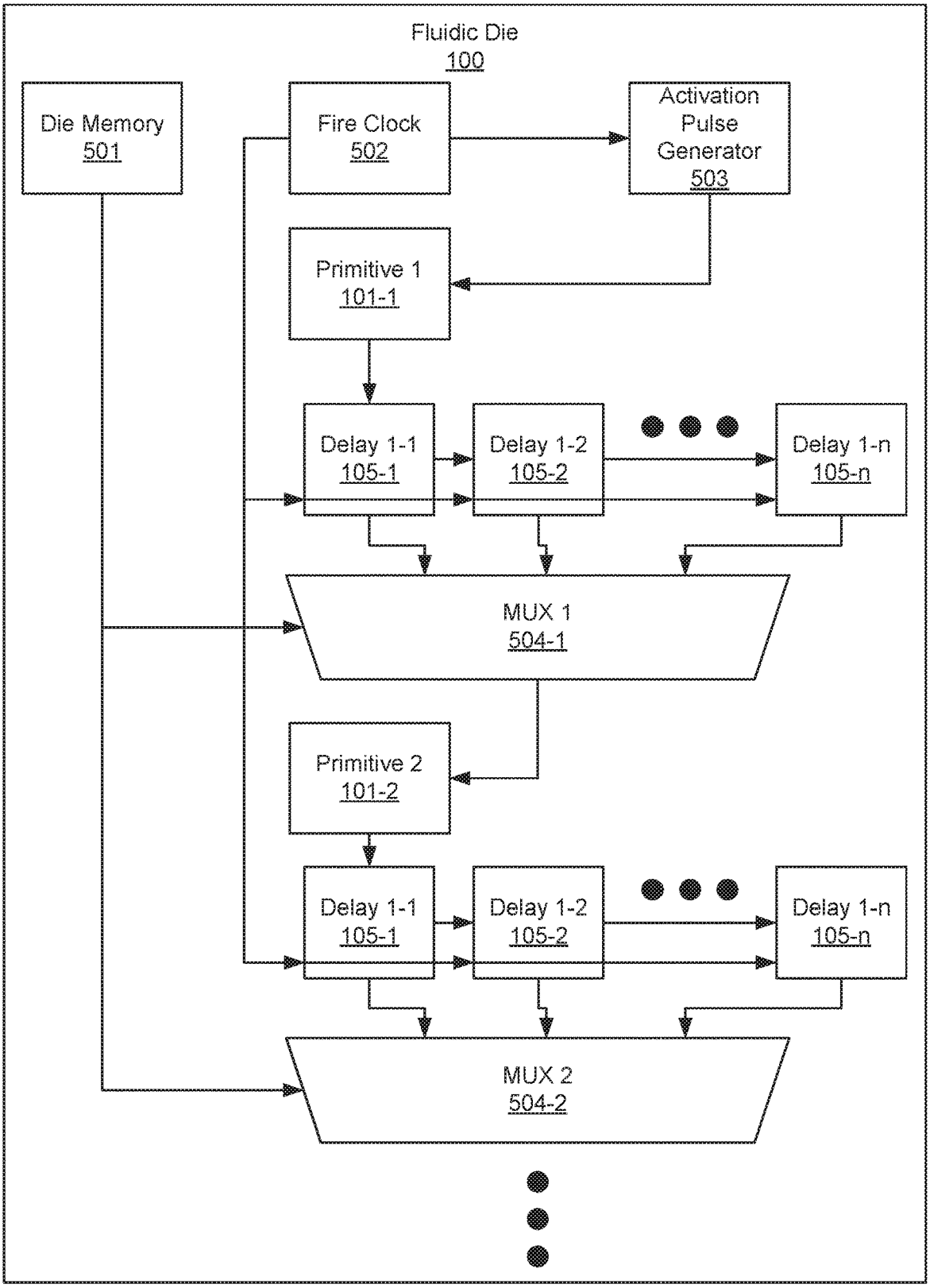
FIG. 5 is a block diagram of a primitive delay design within a fluidic die, according to an example of the principles described herein.
Figure 6:
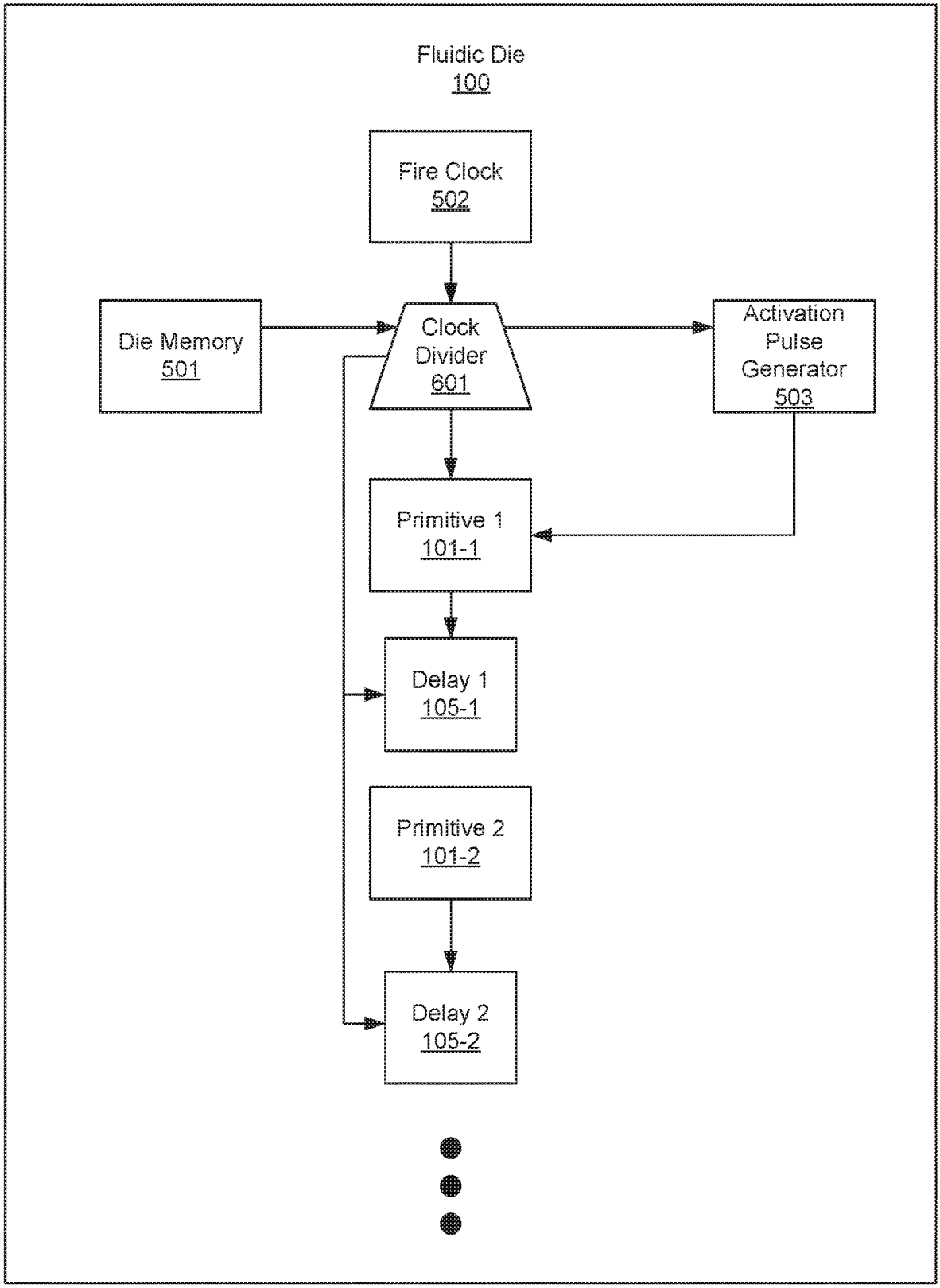
FIG. 6 is a block diagram of a primitive delay design within a fluidic die, according to another example of the principles described herein.

FIG. 5 is a block diagram of a primitive delay design (500) within a fluidic die (100), according to an example of the principles described herein. Similarly-numbered elements included in FIG. 5 and described in connection with FIGS. 1 through 4 designate similar elements within FIG. 5. The primitive delay design (500) of FIG. 5 may include a die memory (501). In one example, the die memory (501) may be located on the fluidic die (100) as depicted in FIGS. 5 and 6. The die memory (501) and other memory devices described herein may include various types of memory modules, including volatile and nonvolatile memory. The die memory (501) may include a computer readable medium, a computer readable storage medium, or a non-transitory computer readable medium, among others. For example, the die memory (501) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The die memory (501) stores printing modes that include registers to select at least one of the delays (105). In one example, the processing device (103) stores in the die memory (501) the desired printing mode among any number of available print modes in order to obtain a desired temporal delay between the primitives (101) and, as a result, a desired peak or maximum current within the column of primitives (101) and print duration. The fluidic die (100) and the printing device (200) may operate in any number of modes, and these modes may define any number of associated temporal delays that may be, in turn, programmed into the delays (105). In one example, the delays (105) of FIG. 4 may be analog delays. In another example, the delays (105) of FIG. 4 may be digital delays where the delays (105) are selected using a digital signal. With the die memory (501), a desired temporal delay may be selected prior to printing by the fluidic die (100) of the printing device (200) through programming the delays (105) using the modes stored in the die memory (501).

The primitive delay design (500) may further include a fire clock (202) to provide a synchronous digital clock signal to coordinate actions of the primitives (101) including, for example, the activation of their respective actuators (102). The fire clock (202) feeds its clock signal to each of the delay blocks (302) including the delays (105).

An activation pulse generator (503) may also be included in the primitive delay design (500). In one example, the activation pulse generator (503) may be located on the fluidic die (100). The activation pulse generator (503) may be any electronic circuit that generates rectangular activation pulses (203), and sends those activation pulses (203) to a first primitive (101-1) in the column of primitives (101). The activation pulse generator (503) may generate a number of activation pulses (203) based on input from the fire clock (202). In one example, the activation pulse generator (503) sends signals to the first primitive (101) that indicate which of the actuators (102) within each primitive (101) are to be activated. In one example, the processing device (103) of the fluidic die (100) may control the activation pulse generator (503) based on the PDL used to control the print job.

The actuators (102) are driven based on a pre-cursor pulse time (PCPT), a dead time (DT), and a fire pulse time (FPT) generated by the fire pulse generator (503). A time for each edge of the activation pulses (302) may be stored in the die memory (501). The activation pulse generator (503) sends the PCPT, DT, and FPT down the column of primitives.

The die memory (501) may be electrically coupled to a number of multiplexers (504-1, 504-2, collectively referred to herein as 504). The multiplexers (504) may be any device that selects one of several analog or digital input signals from the delays (105), and forwards the selected input into a single line to a subsequent primitive (101) within the column of primitives (101) within the fluidic die (100). The multiplexers (504) act as programmable primitive delay selectors by receiving data from the die memory (501) regarding a mode of printing that the printing device (200) has instructed the fluidic die (100) to print with. Thus, with the die memory (501) and the multiplexers (504), a desired temporal delay may be selected prior to printing by the fluidic die (100) of the printing device (200) through programming the delays (105) and the multiplexers (504) using the modes stored in the die memory (501).

The print mode stored in die memory (501) for a print job may include information as to which delays (105) to use during the printing process in order to minimize a peak current within the fluidic die (100) and during each successive activation pulse (203) while attempting to have the activation pulse (203) propagate down the column of primitives (101) and actuators (102) as quickly as possible and completing the overall print job as quickly as possible. The selection of which delays (105) are used for a particular print job is configurable. For example, in a situation where the print job calls for a relatively higher print density where more of the actuators (102) are activated more often, a delay (105) with a relatively higher temporal delay value may be selected in order to ensure that the requested density within the printed document is achieved. In contrast, however, where the speed of printing is a factor and the print density may be relatively lower such as in text documents, a temporally shorter delay may be selected in order to allow the activation pulse (203) to more quickly propagate down the column of primitives (101) and actuators (102) resulting in faster printing.

The activation pulse (203) is fed from the primitives (101) into the delay blocks (303) including the delays (105) and the multiplexer (504). Each of the delays (105) modifies the activation pulse (203) by delaying the activation pulse (203) to a certain temporal degree. These delay signals are then fed to the multiplexer (504). The multiplexer (504) receives instructions from the die memory (501) as to which of the delays (105) to select. In one example, the processing device (103) may store in the die memory (501) the value of delay for a particular print job and its respective activation pulses (203), and that data is sent to each of the multiplexers (504) to cause the multiplexers (504) to select the appropriate delay (105). The delays (105) through which the activation pulses (302) pass may be based on a number of actuators (102) and corresponding nozzles within each primitive (101), the number of primitives (101), a print function or mode stored by the die memory (501), a print demand, or combinations thereof.

As described herein, each delay (105) may be programmed differently to delay the activation pulse (203) to a different temporal amount. In one example, the multiplexers (504) within each delay block (302) select the same delay (105). In this example, an identical temporal delay is experienced between each of the primitives (101). In another example, the multiplexers (504) may select different delays (105) such that a different temporal delay is experienced between at least two separate primitives (101). Further, in one example, a multiplexer (504) may select more than one delay (105) in order to obtain a temporal delay that is a sum of that plurality of delays (105). In this example, the multiplexer (504) is able to select at least two delays (105) and add the total programmed, temporal delay of the at least two delays (105) to obtain a new temporal delay. In one example, this new temporal delay may be an amount of temporal delay unobtainable by selection of any given one of the delays (105) within the delay block (303).

Using the example primitive delay design (500) of FIG. 5, the delay between primitives (101) may be controlled in order to ensure that a peak or maximum current within the fluidic die (100) and its columns of primitives (101) and actuators (102) is maintained below a desired level. This reduction in peak currents and maximum time rate of change of the current (di/dt) avoids over-burdening the power supply to the fluidic die (100) and provides enough power to each actuator (102) within the fluidic die (100). Further, the number of primitives (101) activated at any given time is reduced.

The example of FIG. 5 includes an ellipsis located at the bottom of the figure to indicate that any number of primitives (101) may be included within the fluidic die (100), and a number of delay blocks (303) including their respective delays (105) and multiplexers (504) may be interposed between each of the primitives (101). In this manner, each of the primitives (101) within the fluidic die (100) may be delayed as instructed.

FIG. 6 is a block diagram of a primitive delay design (600) within a fluidic die (100), according to another example of the principles described herein. Similarly-numbered elements included in FIG. 6 and described in connection with FIGS. 1 through 5 designate similar elements within FIG. 6. The example of FIG. 6 may include a clock divider (601). The clock divider (601) may be programmed by the die memory (501) to divide the signal from the fire clock (502). The clock divider (601) divides the signal from the fire clock (502) by an integer to obtain a divided clock signal. This divided clock signal is then sent to each delay (105). In one example, a single delay (105) is included between each primitive (101). Like FIG. 5, FIG. 6 includes an ellipsis located at the bottom of the figure to indicate that any number of primitives (101) may be included within the fluidic die (100), and a number of delays (105) including their respective delays (105) and multiplexers (504) may be interposed between each of the primitives (101). In this manner, each of the primitives (101) within the fluidic die (100) may be delayed as instructed.

In one example, the clock divider (601) may divide the clock signal from the fire clock (502) by an integer. However, in another example, an advanced CMOS-driven process may allow the clock signal from the fire clock (502) by a non-integer ratio if a phase-locked loop (PLL) is included. In one example, the PLL may be located on the fluidic die (100).

The divided clock signal produced by the fire clock (502) and clock divider (601) is sent to each delay (105), and each delay (105) may be programmed to delay the activation of the primitives (101) and their respective actuators (102) based on the divided clock signal. For example, the clock divider (601) may by programmed by the die memory (501) to divide the signal from the fire clock (502) by half. This will result in the resolution of each count within the activation pulse (302) being divided in half and turning on half of the number of primitives (101) during any given time period relative to the number of primitives (101) that may be turned on during that time period without the division. In other words, the clock divider (601) dividing the signal from the fire clock (502) by half would result in a doubling in the delay between primitives (101) and doubling the time it takes for the activation pulse (302) to propagate through all the primitives (101) and their respective actuators (102).

In order to increase the delay between activation of the primitives (101), the clock divider (601) divides the signal from the fire clock (502) further. The delays (105) between each primitive (101) serve to delay the activation of each successive primitive (101) based on the divided signal provided by the clock divider (601).

With reference to FIGS. 5 and 6, the fluidic die (100) programs n sets of delays (105) to delay the actuation of the primitives. If the fluidic die (100) is printing slowly based on, for example, a print mode, the fluidic die (100) may utilize a larger primitive delay to meet a target time rate of change of the current (di/dt), The larger primitive delay decreases the number of primitives (101) that are activated or on within any given time period. High voltages are delivered on a VPP rail, and resistance exists between the power supply and the fluidic die (100). Further, finite parasitics exist on the fluidic die (100) itself to the actuators (102) and down the column of primitives (101). Thus, as current is drawn to activate the actuators (102), a voltage drop occurs on the VPP rail. This voltage drop may be referred to as VPP droop, and the actually realized voltage at the actuators (102) is lower than the original source voltage. The same voltage droop occurs on the power ground return (PGND) where at the voltage source there may be no voltage, but on the fluidic die (100), the voltage for PGND may be higher. This may result in a decrease of the total delta of voltage to be lower than expected given the original source voltage. This VPP droop and PGND rise is a function of how much current is being drawn by the fluidic die (100). The delays (105) eliminate the effect of the VPP droop and PGND rise by providing an activation pulse (302) that overlaps fewer actuators (102) and/or primitives (101)

within a given time period which results in a lower peak current and a reduction in the VPP droop and PGND rise due to the decrease in drawn current. Further, the print density such as drops/600$^{th}$ may be increase due to the decrease in VPP droop and PGND rise.

In an example where one delay (105) per primitive (101) is used, a pre-cursor pulse (PCP) may reach 3 Amps (A) with a dead time (DT) of a certain duration followed by a fire pulse (FP) generated by the fire pulse generator that may reach approximately 8.5 A. In an example where two delays (105) per primitive (101) are used, a pre-cursor pulse (PCP) may reach 1.5 Amps (A) with a dead time (DT) of a certain duration followed by a fire pulse (FP) generated by the fire pulse generator that may reach approximately 5.5 A. In an example where four delays (105) per primitive (101) are used, a pre-cursor pulse (PCP) may reach 0.8 Amps (A) with a dead time (DT) of a certain duration followed by a fire pulse (FP) generated by the fire pulse generator that may reach approximately 2.8 A. As the number of utilized delays (105) increase, the duration of the overall activation pulse or time that current is drawn (equal to a width of the activation pulse (302)) also increases. In one example, the number of delays (105) that may be used may be dependent on an activation frequency. In this example, the printing device (200) may determine how many delays (105) may be used based on what frequency the printing device (200) seeks to print at.

Figure 7:
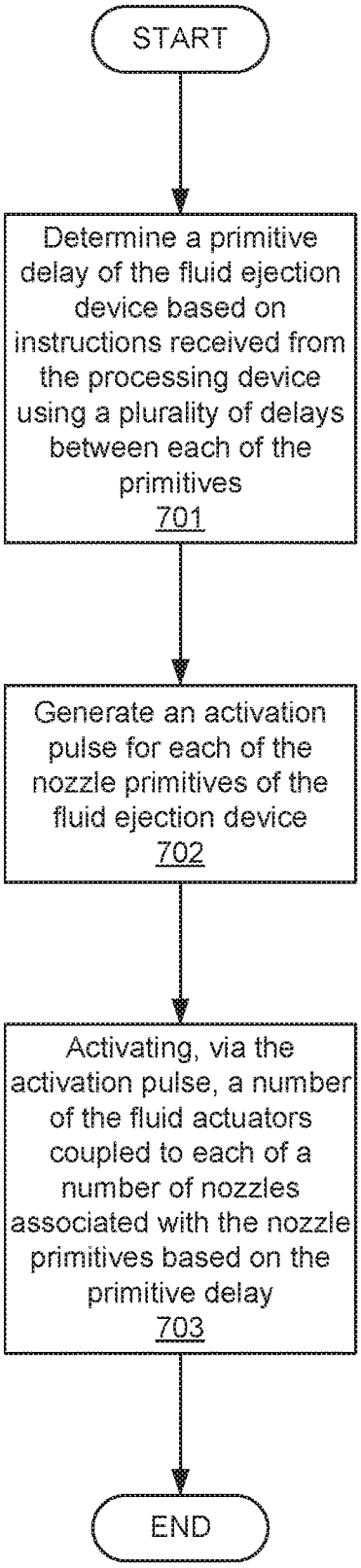
FIG. 7 is a flowchart depicting a method of reducing peak power demands of at least one fluid ejection device, according to an example of the principles described herein.

FIG. 7 is a flowchart depicting a method of reducing peak power demands of at least one fluid ejection device, according to an example of the principles described herein. The method may include, with the processing device (103), determining (block 701) a primitive delay of the fluidic die (100) based on instructions received from the processing device (103). The processing device (103) may instruct the fluidic die (100) to delay a number of activation pulses (302) for a number of actuators (102) within a column of nozzle primitives using a plurality of delays (105) between each of the primitives (101). The method may continue with generating (block 702) an activation pulse (302) for each of the primitives (101) of the fluidic die (100), and activating (block 703), via the activation pulse (302), a number of the actuators (102) coupled to each of a number of nozzles associated with the primitives (101) based on the primitive delay. The method may further include delaying the activation pulses (302) between each of the primitives (101) via a plurality of the delays (105). In this example, the method may include selecting, with a multiplexer (504) coupled to the plurality of the delays (105), a number of signals from the plurality of the delays (105).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processing device (103) of the fluidic die (100) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a fluidic die includes a number of actuators to eject fluid from the fluidic die. The number of actuators form a number of primitives. The fluidic die includes a plurality of delays within a column of the primitives, and a processing device to control the delays through which a number of activation pulses pass. The activation pulses activate each of the actuators associated with the primitives. The activation pulses are delayed between the primitives via at least one of the delays to reduce peak power demands of the fluidic die.

The fluidic die and printing devices described herein provide for programmable selection of primitive delays where any number of delays may be included and the selection of the delays to use may be determined based on data stored on an on-die memory. The delays decrease the maximum time rate of change of the current (di/dt) within the fluidic die.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluidic die comprising:

a number of actuators to eject fluid from the fluidic die, the number of actuators forming a number of primitives;

a plurality of delays within a column of the primitives; and a processing device to control a number of the delays through which a number of activation pulses pass, the activation pulses activating each of the actuators associated with the primitives;

wherein the activation pulses are delayed between the primitives based on how many of the delays are utilized under control of the processing device so as to adjust a delay between primitives to reduce peak power demands of the fluidic die.

2. The fluidic die of claim 1, further comprising an activation pulse generator on the fluidic die, wherein:

the actuators are driven based on a pre-cursor pulse time (PCP), a dead time (DT), and a fire pulse time (FPT) generated by the fire pulse generator, a time for each edge of the activation pulses is stored in a die memory, and the activation pulse generator sends the PCP, DT, and FPT down the column of primitives.

3. The fluidic die of claim 1, wherein the plurality of delays through which the activation pulses pass is based on a number of nozzles within each primitive, the number of primitives, a print function, a print demand, or combinations thereof.

4. The fluidic die of claim 1, wherein the activation pulses comprise a pulse train comprising a number of the activation pulses, wherein the sum of the activation pulses form a total activation energy.

5. The fluidic die of claim 1, wherein the activation pulses are delayed between the primitives via a plurality of the delays.

6. The fluidic die of claim 1, comprising a multiplexer coupled to each primitive to select a number of the signals from the delays.

7. The fluidic die of claim 1, wherein the processing device is to adjust an amount of delay of the activation pulses between primitives based on reducing peak power demand while minimizing print time.

8. The fluidic die of claim 1, wherein the processing device is to adjust an amount of delay of the activation pulses between primitives based on a printing mode being used.

9. The fluidic die of claim 1, further comprising a multiplexer between each pair of primitives, wherein a number of the delays are connected between a previous primitive, through the multiplexer, to a subsequent primitive, wherein the multiplexer is controlled by the processing device to adjust an amount of delay of the activation pulse when passed to the subsequent primitive by selecting which of the number of delays is in a path of the activation signal from the previous primitive to the subsequent primitive.

10. The fluidic die of claim 1, further comprising a programmable clock divider controlled by the processing device, wherein the programmable clock divider divides a signal from a fire clock.

11. A printing device comprising:

a number of fluidic die comprising:

a number of actuators to eject fluid from the fluidic die, the number of actuators forming a plurality of primitives;

a plurality of delays within a column of the primitives, the delays being interposed between each primitive; and a processing device to control a number of delays through which a number of activation pulses pass to adjust an amount of delay between primitives based on reducing peak power demand while minimizing print time, the activation pulses activating the actuators associated with the primitives.

12. The printing device of claim 11, comprising a multiplexer coupled to each primitive to select a number of the signals from the delays based on instructions received from the processing device, the instructions received from the processing device defining a temporal delay between each of the primitives to reduce peak power demands of the fluidic die.

13. The printing device of claim 12, wherein the multiplexer selects a plurality of the signals from the delays.

14. The printing device of claim 11, comprising a programmable clock divider, wherein the programmable clock divider divides a signal from a fire clock to slow down the propagation of the activation pulses down the column of primitives.

15. The printing device of claim 11, wherein a temporal delay between the primitives is based on a number of actuators within each primitive, the number of primitives, a print function, a print demand, or combinations thereof.

16. The printing device of claim 11, wherein the activation pulses comprise a pulse train comprising a number of the activation pulses, wherein the sum of the activation pulses form a total activation energy.

17. A method of reducing peak power demands of at least one fluidic die comprising:

with a processing device:

determining a primitive delay of the fluidic die based on instructions received by the processing device, the processing device instructing the fluidic die to delay a number of activation pulses for a number of actuators within a column of nozzle primitives using a plurality of delays between each of the primitives;

generating an activation pulse for each of the nozzle primitives of the fluidic die; and activating, via the activation pulse, a number of the actuators coupled to each of a number of nozzles associated with the nozzle primitives based on the primitive delay;

wherein the processing device determines an amount of delay between primitives based on a printing mode being used.

18. The method of claim 17, comprising delaying the activation pulses between each of the nozzle primitives via a plurality of the delays.

19. The method of claim 18, comprising selecting, with a multiplexer coupled to the plurality of the delays, a number of signals from the plurality of the delays.

* * * * *